US007787814B2

(12) United States Patent
Smith et al.

(10) Patent No.: US 7,787,814 B2
(45) Date of Patent: Aug. 31, 2010

(54) EDGE WEAR REDUCING PRESSURE ROLLER AND AN ELECTROSTATOGRAPHIC REPRODUCTION MACHINE HAVING SAME

(75) Inventors: Nathan E Smith, Hamlin, NY (US); Linda Gail Price, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 405 days.

(21) Appl. No.: 11/957,611

(22) Filed: Dec. 17, 2007

(65) Prior Publication Data

US 2009/0154966 A1 Jun. 18, 2009

(51) Int. Cl.
*G03G 15/20* (2006.01)

(52) U.S. Cl. ..... 399/331; 399/333

(58) Field of Classification Search ..... 399/328, 399/331, 333

See application file for complete search history.

(56) References Cited

U.S. PATENT DOCUMENTS 4,253,392 A 3/1981 Brandon et al.
4,594,068 A 6/1986 Bardutzky et al.
5,130,754 A 7/1992 Hishikawa
5,253,026 A 10/1993 Tamary
5,490,029 A 2/1996 Madsen et al.
6,969,021 B1 11/2005 Nibarger
2007/0172271 A1 * 7/2007 Hiramoto et al. ..... 399/328

* cited by examiner

*Primary Examiner*—David M Gray
*Assistant Examiner*—Barnabas T Fekete
(74) *Attorney, Agent, or Firm*—Prass LLP

(57) ABSTRACT

An edge wear reducing pressure roller is provided and comprises (a) a roll member having a cylindrical elastomeric outer layer including a longitudinal axis and a length having a first position for supporting a first edge of a copy sheet and a second position for supporting a second edge of the copy sheet; and (b) a cylindrical core located within the cylindrical outer layer also having the longitudinal axis, and a length for supporting the cylindrical elastomeric outer layer. The cylindrical core includes a first segment having a first diameter, and a second segment having a second diameter less than the first diameter for creating variation in elastomeric layer thickness. The second segment advantageously is located directly underneath the first position for supporting the first edge of the copy sheet, and the second position is advantageously located underneath the second position for supporting the second edge of the copy sheet.

22 Claims, 6 Drawing Sheets

EDGE WEAR REDUCING PRESSURE ROLLER AND AN ELECTROSTATOGRAPHIC REPRODUCTION MACHINE HAVING SAME

The present invention relates to electrostatographic image producing machines and, more particularly to an edge wear reducing pressure roller and an electrostatographic reproduction machine having same.

BACKGROUND OF THE DISCLOSURE

One type of electrostatographic reproducing machine is a xerographic copier or printer. In a typical xerographic copier or printer, a photoreceptor surface, for example that of a drum, is generally arranged to move in an endless path through various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as a sheet of paper, and the surface of the photoreceptor is cleaned and prepared to be used once again for the reproduction of a copy of an original. The sheet of paper with the powdered toner thereon in image-wise configuration is separated from the photoreceptor and moved through a fusing apparatus including a heated fusing member and a pressure member forming a fusing nip through which the toner image on the sheet of paper is heated and permanently fixed or fused to the sheet of paper. Typically the fusing apparatus is a roller type apparatus in which the heated fusing member and the pressure member are rollers.

Because copy sheets come in different lengths, fusing apparatus rollers are usually longer longitudinally than most copy sheet lengths. One problem typically encountered in such fusing apparatus when fusing copy sheets shorter (longitudinally) than the fusing rollers is the problem of copy sheet edge wear on the rollers, particularly on the fuser roller. Copy sheet edge wear is premature wear and occurs on the fuser roll and/or pressure roller at where the copy sheet edges are on the inboard and outboard ends of the rollers. The problem as such typically creates undesirable and unscheduled fuser roll and/or pressure roller maintenance/replacement before the fuser module as a whole has reached its end of life. This problem has been around for years, many solutions have been suggested but currently no one effective solution exists.

Prior art that may be relevant in considering the present disclosure for example include what is taught in the following references. U.S. Pat. No. 5,253,026 issued Oct. 12, 1993 to Tamary and entitled "Fusing apparatus having variable shape fuser roller" discloses a fusing apparatus for fusing toner images onto a substrate. The fusing apparatus has a generally cylindrical pressure roller, a fuser roller, and a device for applying toner release oil to the surface there of. The fuser roller further includes a first length portion that has a generally cylindrical outer shape for contacting the pressure roller to form a fusing nip through which the substrate can be moved. In order to prevent damage to the surface of the fuser roller, the fuser roller includes a second length portion which lies towards an end of the fuser roller away from the fusing nip and has a generally conical outer shape for preventing contact between the fuser roller and pressure roller.

U.S. Pat. No. 5,130,754 issued Jul. 14, 1992 to Hishikawa and entitled "Conveying rotatable member and conveying apparatus" discloses an image forming apparatus with an image forming device for forming an unfixed image on a recording material and; first and second rotatable members for forming a nip for conveying the recording material supporting the unfixed image. The second rotatable member has its maximum diameters between a longitudinal center and one longitudinal end and between the center and the other longitudinal end thereof.

U.S. Pat. No. 4,594,068 issued Jun. 10, 1986 to Bardutzky et al. and entitled "Roll-fusing apparatus" discloses a roll-fusing apparatus comprising a heated fusing roller and a pressure roller which form a roller gap therebetween. The shape of the non-cylindrical roller core and the coating of the pressure roller makes it possible to fuse the toner images on copy supports which remain free of wrinkles after passing through the roller gap. In addition, duplication of the copy image does not occur up to DIN A1 size copies. The roller core and the coating of the pressure roller, comprising a silicone elastomer coating and a shrunk-on tubing have varying thicknesses over the length of the roller. As a result, the speed of passage of the copy support at the edges of the roller gap is modified, compared with the speed of passage obtained with a pressure roller having a cylindrical roller core and a cylindrical coating.

U.S. Pat. No. 4,253,392 issued Mar. 3, 1981 to Brandon et al. and entitled "Hollow fuser roll with variable taper" discloses an electrophotographic copier machine with a roll fuser where one of the mating rolls is comprised of a thin outer shell which takes a variable taper so that a concave shape is produced under high humidity conditions and a relatively straight roller is produced under low humidity conditions. Means for changing the support at the roll ends is provided to produce the variable taper. End plugs can be moved axially inward at high humidity to provide support for the end portions of the normally concave roll and can be moved axially outwardly under low humidity such that no support is provided until the roll ends are flattened under the pressure of a mating roll.

U.S. Pat. No. 6,969,021 issued Nov. 29, 2005 to Nibarger and entitled "Variable curvature in tape guide rollers" discloses an apparatus is provided for reducing tape media edge damage in data regions and controlling the position of the tape media in a passive manner. A curved tape guide surface of a tape guide roller controls tape media edge damage by restoring the tape media to a properly aligned position on a tape guide roller by using tape guide rollers with curved edge stops that exert a force to the tape media during a lateral shift. As the tape moves around the roller, the restoring force exerted by the curved portion of the tape guide roller on the tape during any lateral shift restores the tape to a centered position. Keeping the tape media in a centered position reduces tape edge wear, lessens degradation of the integrity of the tape and increases the useful lifetime of the tape.

U.S. Pat. No. 5,490,029 issued Feb. 6, 1996 to Madsen et al. and entitled "Compliant tape guide for data cartridges" discloses a compliant tape guide for magnetic tape transported in a belt driven data cartridge which resiliently engages one edge of a tape and urges the tape to a position against a fixed flange. The compliant tape guide includes a spring strip having a flange end and a spring finger to load the flange end against the tape. The compliant guide reduces tape edge wear as well as providing for better tracking of the tape.

SUMMARY OF THE DISCLOSURE

In accordance with the present disclosure, there has been provided an edge wear reducing pressure roller that comprises (a) a roll member having a cylindrical elastomeric outer layer including a longitudinal axis and a length having a first position for supporting a first edge of a copy sheet and a second position for supporting a second edge of the copy sheet; and (b) a cylindrical core located within the cylindrical outer layer also having the longitudinal axis, and a length for supporting the cylindrical elastomeric outer layer. The cylindrical core includes a first segment having a first diameter, and a second segment having a second diameter less than the first diameter for creating variation in elastomeric layer thickness. The second segment advantageously is located directly underneath the first position for supporting the first edge of the copy sheet, and the second position is advantageously located underneath the second position for supporting the second edge of the copy sheet.

DETAILED DESCRIPTION

Figure 1:
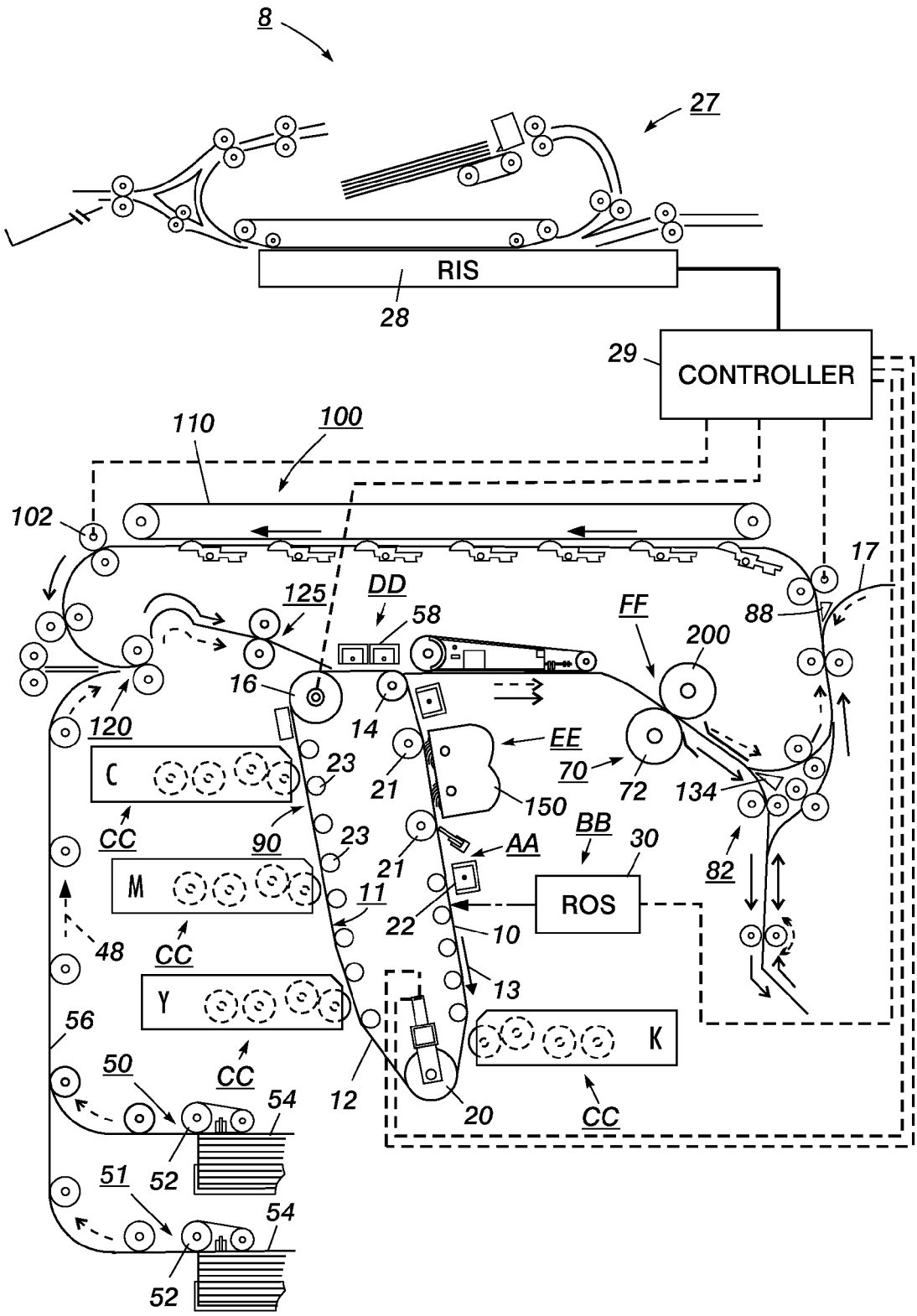
FIG. 1 is a schematic elevational view of an exemplary electrostatographic reproduction machine having a fusing apparatus including the edge wear reducing pressure roller in accordance with the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Vertical transport 56 directs the advancing sheet 48 through feed rolls 120 into registration transport 125, then into image transfer station DD to receive an image from photoreceptor belt 10 in a timed. Transfer station DD typically includes a corona-generating device 58 that sprays ions onto the backside of sheet 48. This assists in attracting the toner powder image from photoconductive surface 12 to sheet 48. After transfer, sheet 48 continues to move in the direction of arrow 60 where it is picked up by a pre-fuser transport assembly and forwarded to fusing station FF.

Fusing station FF includes the fusing apparatus of the present disclosure that is indicated generally by the reference numeral 70 and includes the edge wear reducing pressure roller 200 (to be described in detail below). The fusing apparatus 70 and edge wear reducing pressure roller 200 are suitable for fusing and permanently affixing the transferred toner powder image 74 to the copy sheet 48 with little or no image mottle.

After that, the sheet 48 then passes to a gate 88 that either allows the sheet to move directly via output 17 to a finisher or stacker, or deflects the sheet into the duplex path 100. Specifically, the sheet (when to be directed into the duplex path 100), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser or fusing apparatus 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed there from by a cleaning apparatus 150 at cleaning station EE.

Referring now to FIGS. 2-7, the fusing apparatus 70 and the edge wear reducing pressure roller 200 are illustrated in detail. As shown, the fusing apparatus 70 includes a fuser roller 72 having a heating element 71, and the edge wear reducing pressure roller 200 of the present disclosure. The fuser roller 72 and edge wear reducing pressure roller 200 are mounted rotatably into pressure contact against each other to form a fusing nip 75 for receiving, fusing and permanently affixing the transferred toner powder image 74 to the copy sheet 48. The fusing apparatus 70 as such is driven by a fuser drive assembly (not shown) mounted to one end (for example the inboard end) of the fuser and or edge wear pressure roller.

Figure 3:
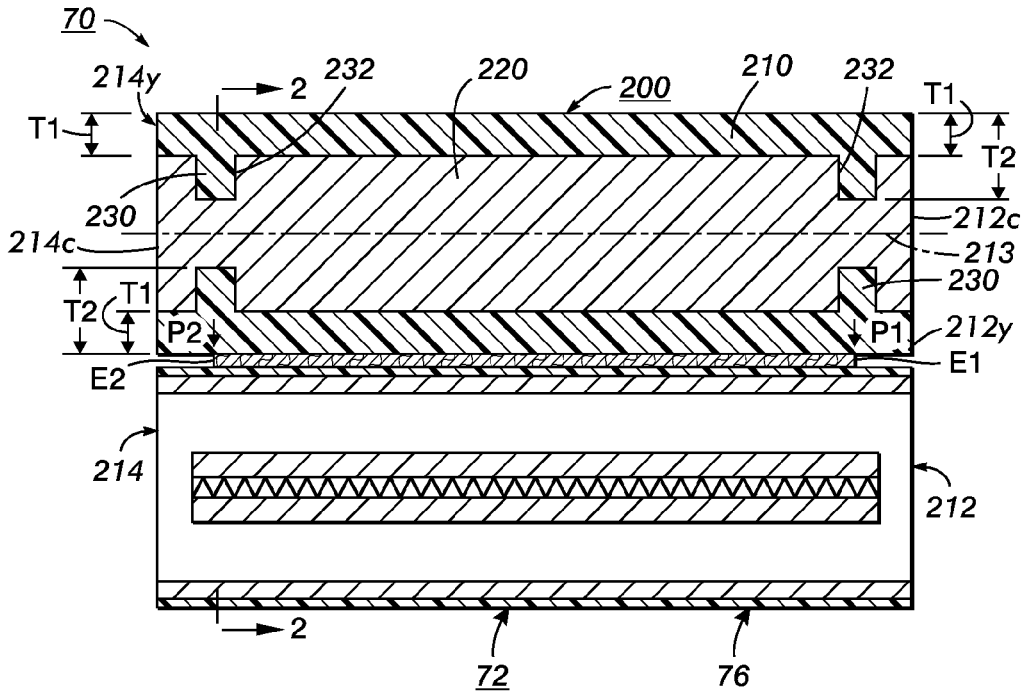
FIG. 3 is an enlarged schematic longitudinal section of the fusing apparatus of FIG. 1 showing the edge wear reducing pressure roller in accordance with the present disclosure.

In operation, copy sheets 48 having a long dimension and a short dimension are fed long dimension into the fusing nip with one short dimension edge (a first edge E1) towards the inboard end 212 of the fusing nip 75, and with the other short dimension edge (a second edge E2) towards the outboard end 214 of the fusing nip 75 as shown in FIG. 3. Copy sheets 48 can be fed as such in an end-justified manner where the first edge E1 for example is registered at a point closest the inboard end 212 of the fusing nip; or centered-justified where the sheet 48 is registered so as to be centered within the fusing nip 75. Where the first edge E1 and the second edge E2 of a copy sheet 48 lie or are positioned within the fusing nip 75 thus depend on paper size and on whether the sheet is fed end-justified or center-justified.

Figure 4:
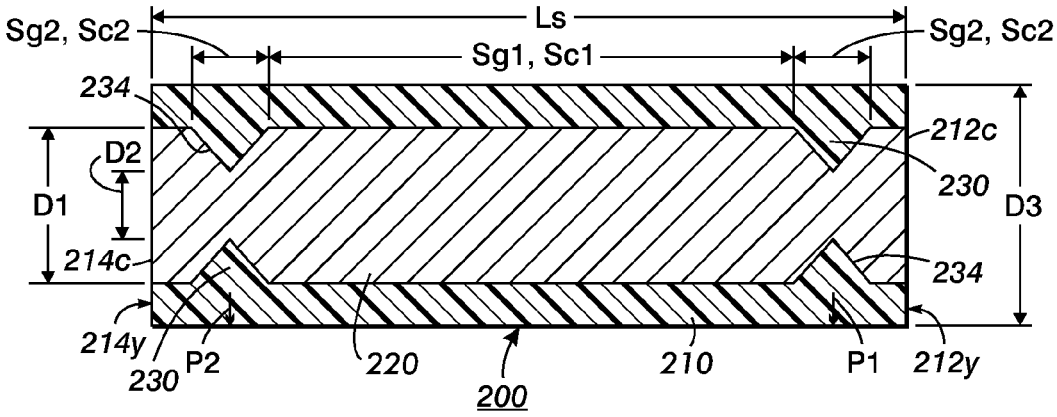
FIG. 4 is an enlarged schematic longitudinal section of the edge wear reducing pressure roller in accordance with the present disclosure.

As shown more clearly in FIGS. 3 and 4, the edge wear reducing pressure roller 200 includes an elastomeric layer 210 and a stepped or grooved core/substrate 220 for increasing a thickness of the elastomeric layer 210 on the pressure roller 200 from T1 to T2 at the copy sheet first edge E1 supporting position P1 and at the second edge E2 supporting position P2. The additional or greater elastomeric layer thickness T2 at these lead edge and second edge supporting positions P1, P2 on the pressure roller 200 will effectively reduce the amount of pressure, pressure reaction or contact, and shear stresses on the pressure roller and fuser roller at these copy sheet edge supporting positions. The reduced pressure reduces any shear stress being transmitted to the fuser roller 72 due to velocity differentials at these copy sheet edge supporting positions P1, P2 inside the fusing nip 75. The advantageous result is a reduction in stresses on the surface coating 76 of the fuser roller 72, thus decreasing the wear rate at the copy sheet support positions, avoiding undesirable unscheduled maintenance and increasing the life of the overall fusing apparatus 70.

The first step in making this proposed pressure roller 200 would be to create a groove, step, or profile 230 at longitudinally spaced apart strategic points as shown for example in the core 220. This will most likely be done during the grinding or turning process. The second step would be to apply the elastomeric layer 210 over entire the core 220.

Figure 2:
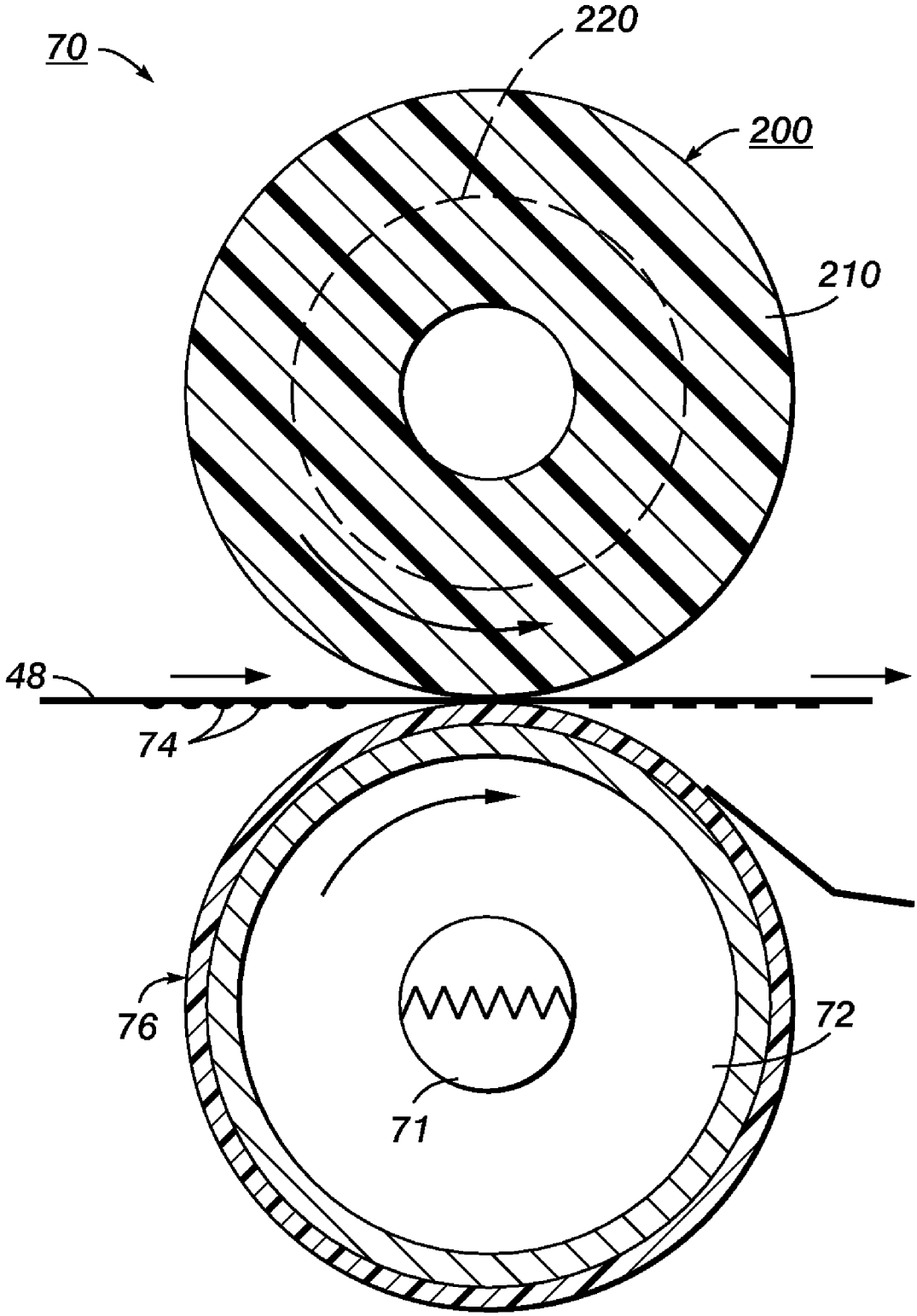
FIG. 2 is an enlarged end section schematic of the fusing apparatus of FIG. 1 showing the edge wear reducing pressure roller in accordance with the present disclosure.

More specifically, as shown in FIGS. 2-4, the present disclosure is directed to an edge wear reducing pressure roller 200 that comprises (a) a generally cylindrical elastomeric outer layer 210 and (b) a generally cylindrical core 220 located within the generally cylindrical outer layer. The generally cylindrical elastomeric outer layer 210 has a first end at 212*y*, a second end at 214*y*, a longitudinal axis 213, and a length Ls for longitudinally supporting a copy sheet 48 having an inboard first edge E1 and a second edge E2. The length Ls has a first position P1 for supporting the first edge of the copy sheet and a second position P2 for supporting the second edge of the copy sheet. The generally cylindrical core 220 also has a first end 212*c*, a second end 214*c*, the longitudinal axis 213, and the length Ls for supporting the generally cylindrical elastomeric outer layer 210. The generally cylindrical core 220 includes a first segment Sg1 having a first diameter D1, and a second segment Sg2 having a second diameter D2 less than the first diameter D1 for creating a variation in elastomeric layer thickness T1, T2 between the segments Sg1, Sg2. The at least second segment Sg2 is advantageously located directly below the first position P1 for supporting the first edge E1 of the copy sheet 48, and/or below the second position P2 for supporting the second edge E2 of the copy sheet 48 for reducing contact pressure between the pressure roller 200 and a fusing nip forming fuser roller 72, and hence edge wear.

The generally cylindrical elastomeric outer layer 210 has a uniform outer diameter D3 from the first end 212*y* to the second end 214*y*. The generally cylindrical elastomeric outer layer 210 as such has a first thickness T1 in the first segment Sg1 and a second thickness T2 in the second segment Sg2 that is greater than the first thickness T1. The second thickness T2 is coincident with the first position P1 for supporting the first edge E1 of the copy sheet 48 and with the second position P2 for supporting the second edge E2 of the copy sheet 48. The generally cylindrical core 220 for example is made of a metallic material as illustrated.

Although two positions P1, P2 are shown for example, there could be only one position P1 or P2. As shown, the first position P1 and the second position P2 for example may be located spaced equidistantly from a longitudinal center of the length of the generally cylindrical elastomeric outer layer 210, or as needed. The first position P1 is located towards the first end 212*y* and the second position P2 is spaced longitudinally from the first position P1 towards the second end 214*y* of the generally cylindrical elastomeric outer layer 210.

Figure 5:
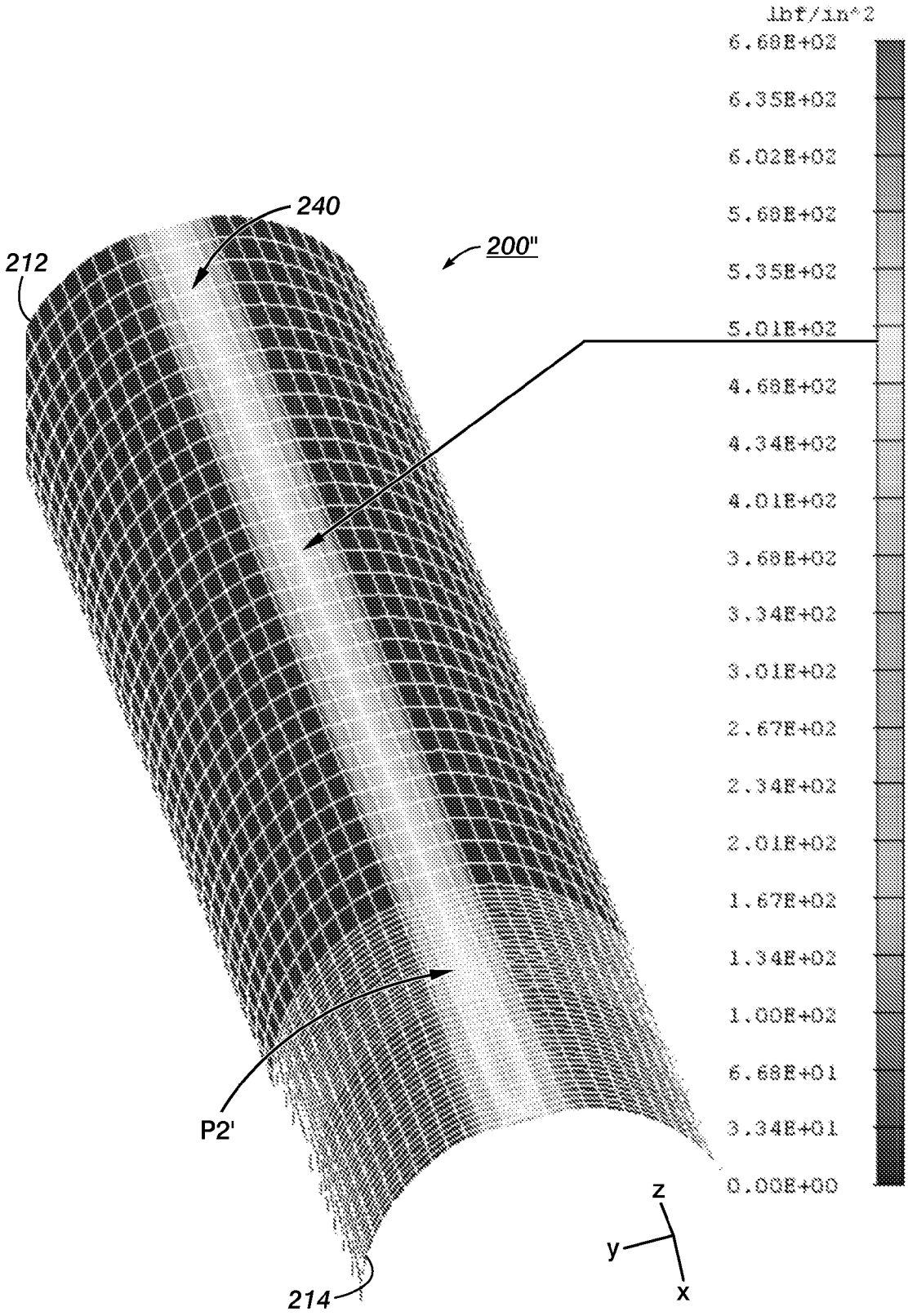
FIG. 5 is a graphical plot of fuser roller contact pressure profile from a conventional pressure roller during fusing of a copy sheet under given conditions.
Figure 6:
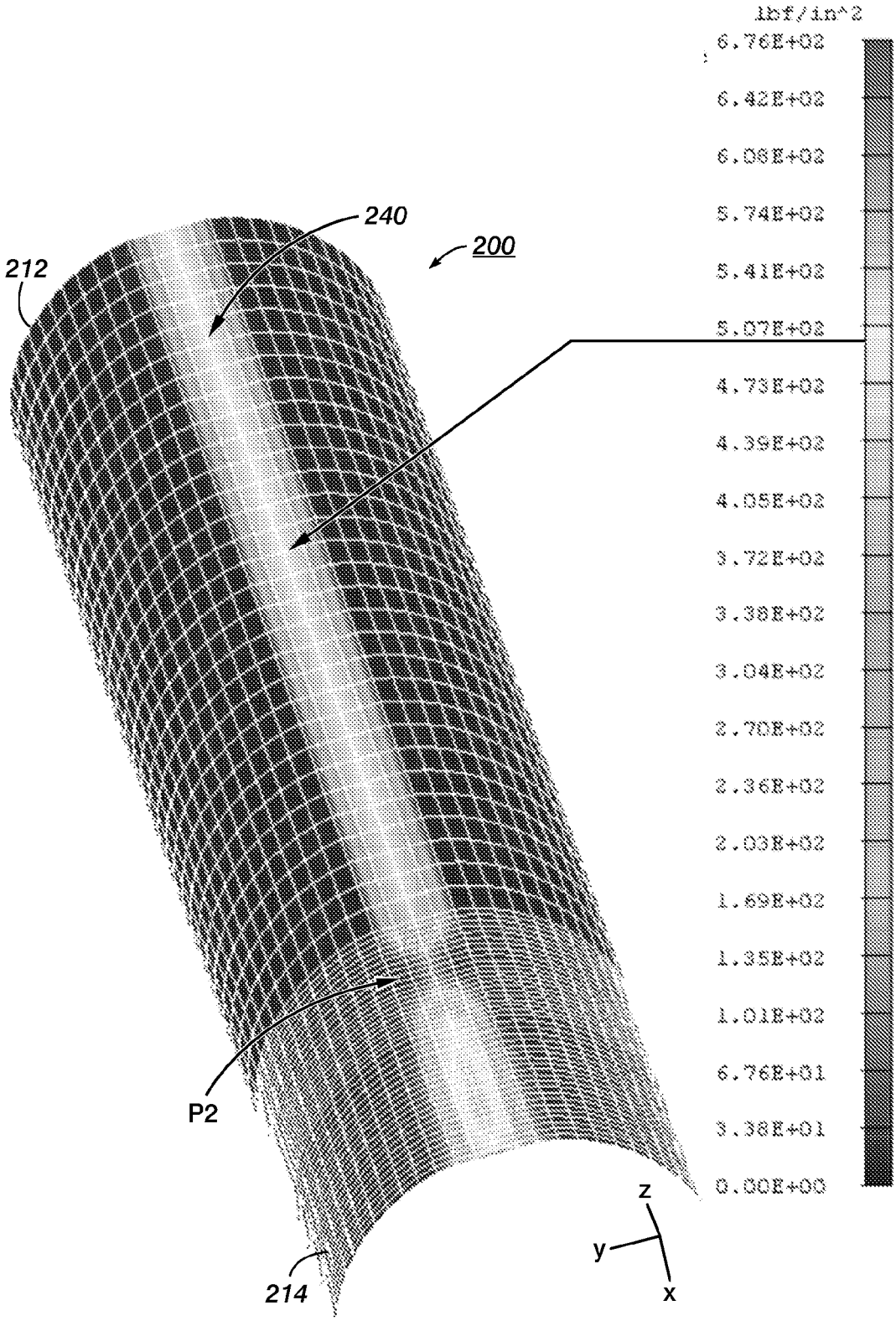
FIG. 6 is a graphical plot of fuser roller contact pressure profile from an edge wear reducing pressure roller during fusing of a copy sheet during fusing of a copy sheet under the conditions of FIG. 5 in accordance with the present disclosure.
Figure 7:
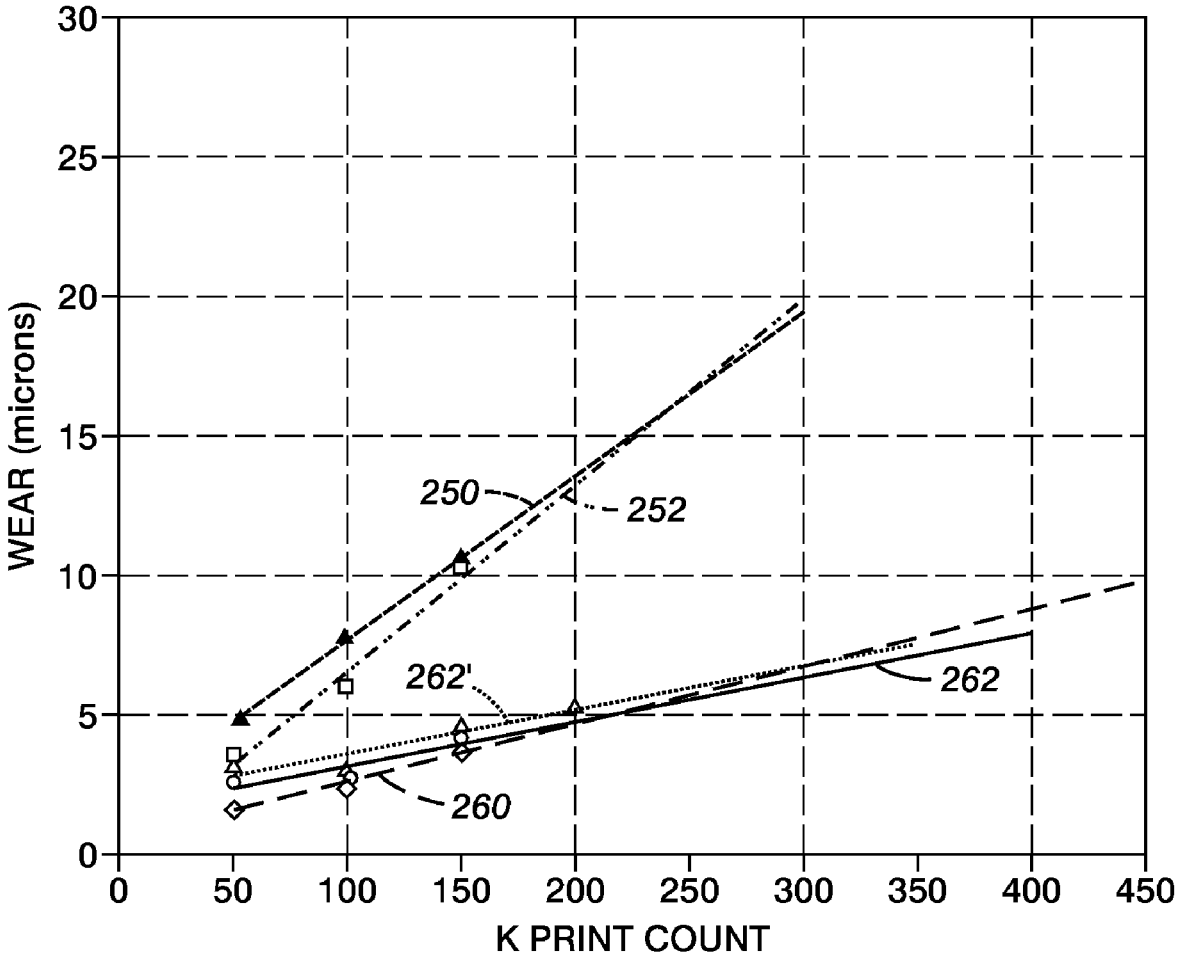
FIG. 7 is a graphical plot of measured wear (in microns) on the fuser roller against a number (in K copy count) of sheets fed through the fusing apparatus of the present disclosure.

Referring now to FIGS. 5-7, experimentally, the concept and principles of the present disclosure along with temperature effects were tested on a static mechanical model. The model was basically a pressure roller being loaded onto a flat surface. FIG. 5 shows a profile for a conventional straight (un-grooved core) pressure roller 200", while FIG. 6 shows the same with a pressure roller 200 grooved in accordance with the present disclosure.

Measurements, particularly pressure and wear, were obtained and an analysis was performed to determine the primary structural and thermal factors affecting premature fuser roller edge wear. Both in the lab and in service it was observed that edge wear occurred at the fastest rate on that end of the fuser roller where the copy sheet edge was farthest away from the free or distal (that is, the non-drive equipment) or outboard end 214 of the pressure roller 200. Single effects analyses were done to assess a number of factors that could cause this edge wear bias. A number of different potential factors were analyzed for that, and particularly for their relative contribution to fuser-pressure roller interface pressure. Among the factors analyzed, (1) thermal loads/thermal expansion of the pressure roller; and (2) variation in the thickness of the elastomeric layer 210 of the pressure roller were found to be significant factors affecting premature fuser roller edge wear.

With respect to these first significant factors, the first (thermal loads/thermal expansion of the pressure roller) as shown comparatively in FIGS. 5 and 6, it was found that thermal expansion of the pressure roller creates and results in a roller to roller contact pressures gradient 240 along the longitudinal axis 213 of the pressure roller 200, 200". On the one hand, the highest contact pressures were found to occur around the center of the pressure roller 200, 200". On the other hand, contact pressures were found to consistently decrease towards the free end (outboard, non-drive equipment end) of the pressure roller 200 of the present disclosure given uniform thermal loads.

With respect to the second significant factor (variation in pressure roller elastomeric layer thickness), as clearly shown in FIG. 6 compared to FIG. 5, it was found that a relatively thicker T2 elastomeric layer 210 around the position P1, P2 under the copy sheet edge E1, E2 significantly reduced contact pressure 240. As shown, the relatively increased thickness T2 of the elastomeric layer 210 is designed to occur in the area of the cutouts 230 in the core 220 of the pressure roller, and to be at the copy sheet edge location P1, P2, P2' between the pressure and fuser rollers.

Based on the above, it was concluded that reducing the contact pressure at the edge wear end (in the location of the copy sheet edge) could reduce edge wear. Comparative models (see FIG. 7) show that this reduction can be accomplished with pressure roller core cut-outs. The model examines contact pressure along the pressure roller axis and how the pressure is affected by thermal loads, cure shrinkage and pressure roller core cutouts.

As shown in FIG. 7, the measured wear (in microns) on a fuser roller 72 is plotted against a number (in K copy count) of sheets fed through the fusing apparatus. Two baseline tests were run on conventional un-grooved pressure rollers 200" (black dotted lines 250, 252) to show repeatability and to obtain a wear rate. The results of one grooved core pressure roller 200 (in accordance with the present disclosure) tested are shown by the dashed line 260. The solid line 262 represents the results of another grooved pressure roller 200 with a repeat shown as the dotted line 262'. Overall, these base line tests show a 0.0676 wear rate for conventional un-grooved pressure rollers 200" (black dotted lines 250, 252), whereas the grooved core pressure rollers 200 show only a 0.0205 wear rate (approximately a 3× reduction) under the same conditions.

Thus to recap, the present disclosure is directed to an edge wear reducing pressure roller 200, a fusing apparatus 70 including such a pressure roller and an image producing machine 8 including such a fusing apparatus. As illustrated and described, the edge wear reducing pressure roller 200 includes (a) a generally cylindrical elastomeric outer layer 210 having a first end 212*y*, a second end 214*y*, a longitudinal axis 213, and a length Ls for longitudinally supporting a copy sheet 48 having a first edge E1 and a second edge E2, the length Ls having a first position P1 for supporting the first edge of the copy sheet and a second position P2 for supporting the second edge of the copy sheet; and (b) a generally cylindrical core 220 located within the generally cylindrical outer layer for supporting the generally cylindrical elastomeric outer layer, the generally cylindrical core 220 including a first segment Sg1 having a first diameter D1, and a second segment Sg2 having a second diameter D2 less than the first diameter for creating variation in elastomeric layer thickness T1, T2, and the second segment Sg2 being located directly below the first position P1 for supporting the first edge E1 of the copy sheet, as well as below the second position P2 for supporting the second edge E2 of the copy sheet.

In one embodiment of the edge wear reducing pressure roller 200, the second segment Sg2 of the core 220 comprises a cutout or groove 230 with rectangular stepped sides 232. In another embodiment, it comprises a cutout or groove 230 with tapered sides 234. The generally cylindrical elastomeric outer layer 210 has a uniform outer diameter D3 from the first end to the second end. It also then has a first section Sc1 having a first thickness T1 and a second section Sc2 having a second thickness T2 greater than the first thickness, with the second thickness T2 being coincident with the first position P1 for supporting the first edge of the copy sheet, as well as with the second position P2 for supporting the second edge of the copy sheet. The generally cylindrical core 220 can be made of a metallic material. The first position P1 and the second position P2 could be located spaced equidistantly from a longitudinal center—of the length of the generally cylindrical elastomeric outer layer. The first position P1 could be located towards the first end 212*y* and the second position P2 is then spaced longitudinally from the first position towards the second end 214*y* of the generally cylindrical elastomeric outer layer.

As can be seen there has been provided an edge wear reducing pressure roller that comprises (a) a roll member having a cylindrical elastomeric outer layer including a longitudinal axis and a length having a first position for supporting a first edge of a copy sheet and a second position for supporting a second edge of the copy sheet; and (b) a cylindrical core located within the cylindrical outer layer also having the longitudinal axis, and a length for supporting the cylindrical elastomeric outer layer. The cylindrical core includes a first segment having a first diameter, and a second segment having a second diameter less than the first diameter. The second segment advantageously is located directly underneath the first position for supporting the first edge of the copy sheet, and the second position is advantageously located underneath the second position for supporting the second edge of the copy sheet.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An edge wear reducing pressure roller, comprising:

(a) a generally cylindrical elastomeric outer layer having a first end, a second end, a longitudinal axis, and a length for longitudinally supporting a copy sheet having a first edge and a second edge opposite to said first edge, said generally cylindrical elastomeric outer layer having a first position along said length for supporting said first edge of said copy sheet and a second position along said length for supporting said second edge of said copy sheet; and (b) a generally cylindrical core located within said generally cylindrical outer layer and having a first end, a second end, said longitudinal axis, and a length for supporting said generally cylindrical elastomeric outer layer, said generally cylindrical core including a first segment having a first diameter, and a second segment having a second diameter less than said first diameter for creating variation in thickness of said generally cylindrical elastomeric outer layer, said first segment supporting a first section of said generally cylindrical elastomeric outer layer having a generally uniform first thickness between said first position and said second position, said second segment being located at least directly below said first position for supporting said first edge of said copy sheet.

2. The edge wear reducing pressure roller of claim 1, wherein said generally cylindrical elastomeric outer layer has a uniform outer diameter from said first end to said second end.

3. The edge wear reducing pressure roller of claim 1, wherein said generally cylindrical elastomeric outer layer has a second section having a second thickness greater than said first thickness, said second thickness being coincident with said first position for supporting said first edge of said copy sheet, as well as being coincident with said second position for supporting said second edge of said copy sheet.

4. The edge wear reducing pressure roller of claim 1, wherein said second segment is located at least directly below said first position for supporting said first edge of said copy sheet and directly below said second position for supporting said second edge of said copy sheet.

5. The edge wear reducing pressure roller of claim 1, wherein said first position and said second position are located spaced equidistantly from a longitudinal center of said length of said generally cylindrical elastomeric outer layer.

6. The edge wear reducing pressure roller of claim 1, wherein said first position is located towards said first end and said second position is spaced longitudinally from said first position towards said second end of said generally cylindrical elastomeric outer layer.

7. A fusing apparatus, comprising:

(a) a heated rotatable fuser roll; and (b) a rotatable edge wear reducing pressure roller forming a fusing nip with said heated rotatable fuser roll, said rotatable edge wear pressure roller including:

(i) a generally cylindrical elastomeric outer layer having a first end, a second end, a longitudinal axis, and a length for longitudinally supporting a copy sheet having a first edge and a second edge opposite to said first edge, said generally cylindrical elastomeric outer layer having a first position along said length for supporting said first edge of said copy sheet and a second position along said length for supporting said second edge of said copy sheet; and (ii) a generally cylindrical core located within said generally cylindrical outer layer and having a first end, a second end, said longitudinal axis, and a length for supporting said generally cylindrical elastomeric outer layer, said generally cylindrical core including a first segment having a first diameter, and a second segment having a second diameter less than said first diameter for creating variation in thickness of said generally cylindrical elastomeric outer layer, said first segment supporting a first section of said generally cylindrical elastomeric outer layer having a generally uniform first thickness between said first position and said second position, said second segment being located directly below said first position for supporting said first edge of said copy sheet, and below said second position for supporting said second edge of said copy sheet.

8. The fusing apparatus of claim 7, wherein said generally cylindrical elastomeric outer layer has a uniform outer diameter from said first end to said second end.

9. The fusing apparatus of claim 7, wherein said generally cylindrical elastomeric outer layer has a second section having a second thickness greater than said first thickness, said second thickness being coincident with said first position for supporting said first edge of said copy sheet, as well as being coincident with said second position for supporting said second edge of said copy sheet.

10. The fusing apparatus of claim 7, wherein said generally cylindrical core is made of a metallic material.

11. The fusing apparatus of claim 7, wherein said first position and said second position are located spaced equidistantly from a longitudinal center of said length of said generally cylindrical elastomeric outer layer.

12. The fusing apparatus of claim 7, wherein said first position is located towards said first end and said second position is spaced longitudinally from said first position towards said second end of said generally cylindrical elastomeric outer layer.

13. An electrostatographic reproduction machine, comprising:

(a) a moveable imaging member including an imaging surface;

(b) imaging means for forming and transferring a toner image onto a toner image carrying sheet; and (c) fusing apparatus having a heated rotatable fuser roll and a rotatable edge wear reducing pressure roller forming a fusing nip with said heated rotatable fuser roll, said rotatable edge wear pressure roller including:

(i) a generally cylindrical elastomeric outer layer having a first end, a second end, a longitudinal axis, and a length for longitudinally supporting a copy sheet having a first edge and a second edge opposite to said first edge, said generally cylindrical elastomeric outer layer having a first position along said length for supporting said first edge of said copy sheet and a second position along said length for supporting said second edge of said copy sheet; and (ii) a generally cylindrical core located within said generally cylindrical outer layer and having a first end, a second end, said longitudinal axis, and a length for supporting said generally cylindrical elastomeric outer layer, said generally cylindrical core including a first segment having a first diameter, and a second segment having a second diameter less than said first diameter for creating variation in thickness of said generally cylindrical elastomeric outer layer, said first segment supporting a first section of said generally cylindrical elastomeric outer layer having a generally uniform first thickness between said first position and said second position, said second segment being located directly below said first position for supporting said first edge of said copy sheet, and below said second position for supporting said second edge of said copy sheet.

14. The electrostatographic reproduction machine of claim 13, wherein said generally cylindrical elastomeric outer layer has a uniform outer diameter from said first end to said second end.

15. The electrostatographic reproduction machine of claim 13, wherein said generally cylindrical elastomeric outer layer has a second section having a second thickness greater than said first thickness, said second thickness being coincident with said first position for supporting said first edge of said copy sheet, as well as being coincident with said second position for supporting said second edge of said copy sheet.

16. The electrostatographic reproduction machine of claim 13, wherein said generally cylindrical core is made of a metallic material.

17. The electrostatographic reproduction machine of claim 13, wherein said first position and said second position are located spaced equidistantly from a longitudinal center of said length of said generally cylindrical elastomeric outer layer.

18. The electrostatographic reproduction machine of claim 13, wherein said first position is located towards said first end and said second position is spaced longitudinally from said first position towards said second end of said generally cylindrical elastomeric outer layer.

19. The electrostatographic reproduction machine of claim 13, wherein said second segment of said core comprises a cutout with stepped sides.

20. The electrostatographic reproduction machine of claim 13, wherein said second segment of said core comprises a cutout with tapered sides.

21. An edge wear reducing pressure roller, comprising:

a generally cylindrical elastomeric outer layer having a first end, a second end, a longitudinal axis, and a length for longitudinally supporting a copy sheet having a first edge and a second edge opposite to the first edge, the generally cylindrical elastomeric outer layer having a first position along the length and spaced longitudinally from the first end for supporting the first edge of the copy sheet, a second position along the length and spaced longitudinally from the second end for supporting the second edge of the copy sheet and a maximum thickness coincident with the first position and the second position; and a generally cylindrical core located within the generally cylindrical outer layer and having a first end, a second end, the longitudinal axis, and a length for supporting the generally cylindrical elastomeric outer layer, the generally cylindrical core including a first segment having a first diameter, and a second segment having a second diameter less than the first diameter, the second segment being located directly below the first position and the second position.

22. An edge wear reducing pressure roller, comprising:

a generally cylindrical elastomeric outer layer having a first end, a second end, a longitudinal axis, and a length for longitudinally supporting a copy sheet having a first edge and a second edge opposite to the first edge, the generally cylindrical elastomeric outer layer having a first position along the length for supporting the first edge of the copy sheet and a second position along the length for supporting the second edge of the copy sheet; and a generally cylindrical core located within the generally cylindrical outer layer and having a first end, a second end, the longitudinal axis, and a length for supporting the generally cylindrical elastomeric outer layer, the generally cylindrical core including a first segment having a first diameter, and a second segment having a second diameter less than the first diameter for creating variation in thickness of the generally cylindrical elastomeric outer layer, the second segment comprising a first cutout or groove located directly below the first position and a second cutout or groove located directly below the second position.

* * * * *